United States Patent [19]

Ishikawa

[11] 4,267,221

[45] May 12, 1981

[54] ARCHITECTURAL PANEL AND METHOD OF MAKING THE SAME

[76] Inventor: Takashi Ishikawa, No. 1355, Ooaza Higashine Ko, Higashine-shi, Yamagata-ken, Japan

[21] Appl. No.: 138,816

[22] Filed: Apr. 9, 1980

Related U.S. Application Data

[63] Continuation of Ser. No. 931,498, Aug. 7, 1978, abandoned.

[30] Foreign Application Priority Data

| | | | |
|---|---|---|---|
| Aug. 23, 1977 | [JP] | Japan | 52-102031 |
| Sep. 24, 1977 | [JP] | Japan | 52-114931 |
| Apr. 22, 1978 | [JP] | Japan | 53-53759[U] |
| May 11, 1978 | [JP] | Japan | 53-63065[U] |

[51] Int. Cl.[3] ..... B32B 3/30; B32B 5/16; B32B 27/14

[52] U.S. Cl. ..... 428/121; 428/44; 428/57; 428/142; 428/144; 428/150; 428/174; 428/187; 428/192; 428/204; 428/206; 428/207; 428/209; 428/210; 428/325; 428/329; 428/330; 428/331; 428/337; 428/338; 428/339; 428/406; 428/407; 52/588

[58] Field of Search ..... 428/142–144, 428/150, 173, 174, 179, 147, 149, 187, 204, 206, 207, 209, 210, 325, 331, 338, 339, 402, 404, 406, 407, 121, 192, 329, 330, 337; 427/197–199, 203, 204; 52/316, 177, 588

[56] References Cited

U.S. PATENT DOCUMENTS

| | | | |
|---|---|---|---|
| 1,304,749 | 5/1919 | Divine | 427/198 X |
| 1,407,461 | 2/1922 | Epstein | 427/197 |
| 2,130,704 | 9/1938 | Patzwaldt | 427/197 X |
| 2,711,970 | 6/1955 | Hollmann | 427/198 |
| 3,085,025 | 4/1963 | Eaton | 427/198 X |
| 3,916,577 | 11/1975 | Vare | 52/588 X |

FOREIGN PATENT DOCUMENTS

| | | | |
|---|---|---|---|
| 869769 | 6/1961 | United Kingdom | 427/198 |

*Primary Examiner*—Marion McCamish
*Assistant Examiner*—Alexander S. Thomas
*Attorney, Agent, or Firm*—Blanchard, Flynn, Thiel, Boutell & Tanis

[57] ABSTRACT

An architectural panel produced by forming a raised or depressed pattern in the surface of a base plate and sprinkling and sticking particulate material to both or either of the depressions and protrusions to provide the architectural panel with an excellent three-dimensional effect by virtue of the combined effect of the pattern and the particulate material. According to one form of the invention, an architectural panel having an excellent three-dimensional effect and massiveness is produced by using a metallic base plate and overcoming the feeling of smoothness and lightness peculiar to metallic material with the combined effect of such pattern and particulate material. According to another form of the invention, an architectural panel is produced by applying a base coat layer and/or an overcoat layer to a base plate to provide an excellent design quality and protection against fall-off of the particulate material.

9 Claims, 27 Drawing Figures

ARCHITECTURAL PANEL AND METHOD OF MAKING THE SAME

This is a continuation of application Ser. No. 931,498, filed Aug. 7, 1978 abandoned.

BACKGROUND OF THE INVENTION

It is a matter of course that an architectural panel must satisfy various conditions required for an architectural material, such as, strength, weathering resistance, heat insulating properties, water resistance, etc. However, the architectural panel must satisfy, in addition to these physical requirements, design requirements which appeal to the sense of sight of man. It is well known that recent technical progress has lead to the development of architectural materials which meet the previously mentioned requirements, and many different types of architectural materials are now on the market. For example, metal sheets designed for use on architectural external walls include colored iron sheets (ie., precoated galvanized sheets), PVC coated steel sheets, aluminum sheets, etc. Although oganic materials (e.g., synthetic resins) and inorganic materials (e.g., slate and plaster boards) are in use, metallic sheets are used in far greater amounts owing to ease of working, ease of mass production at relatively low cost and other reasons. However, the properties peculiar to metallic sheets, e.g., smoothness and lightweight properties and the hand and feel peculiar to metallic sheets will function adversely in the case of architectural materials depending on applications. Particularly, in consideration of design requirements appealing to the sense of sight of man, it is not infrequent that metallic sheets will be used in limited applications or they will be replaced by other materials such as wood and stone.

The recent tendency is toward adding desired organic and/or inorganic features to metallic materials. For example, the previously mentined PVC coated steel sheet is representative of this type of material and it is produced by applying an organic PVC coating to the metallic surface of a steel sheet. Another example is one produced by sprinkling and sticking inorganic sand to the surface of a colored iron sheet to provide it with a mortar-like appearance. However, to the best of the inventor's knowledge, the architectural materials known in the art are all such that their hand and feed are not changed substantially. To be more precise, even if a metallic material is changed to some extent, an observer will still feel the texture and appearance of the metallic sheet itself. While many reasons may be conceived, the most essential reason is the fact that since practically all the known architectural panels have a decorative surface layer produced by applying a coating or spreading sand uniformly on the smooth surface of the base material, those architectural panels have the disadvantages of lacking a three-dimensional effect, showing the uniform feel of products produced by machinery, lacking a pleasing appearance owing to a lack of unbalance and a tendency of the sand on the base material to fall off and after all showing only the feel of the base material itself.

SUMMARY OF THE INVENTION

The present invention has been created in view of these circumstances and it relates to a panel best suited for use as an architectural material. More particularly, the invention relates to the production of an architectural panel made by forming depressions and protrusions in the surface of a base panel made of a metallic or other material (moreover the depressions and protrusions may be arranged in a great many different types of patterns in the base panel surface), sprinkling a particulate material onto both or either of the depressed and raised surface portions and then sticking the particulate material onto both or either of the depressed and raised surface portions thereby providing the combined effect of the depressions and protrusions and the particulate material, particularly a three-dimensional effect, massive feel, natural effect, etc. According to another form of the invention, an architectural panel is provided in which the combined effect of such depressions and protrusions and particulate material are further improved by means of an additional coating or coatings.

It is therefore a first object of the invention to provide an architectural panel having a three-dimensional effect, massive effect, natural effect, etc., on an observer by virtue of the combination of the following (a) and (b); or (a), (b) and (c) in addition to other conditions, such as, the material, size, color, gloss and so on:

(a) forming depressions and protrusions in the surface of a base panel to make therein as many different types of patterns as possible;

(b) using an organic particulate material and/or an inorganic particulate material in combination with the depressions and protrusions; and (c) using a base coat layer and/or an overcoat layer in combination with the above (a) and (b).

It is a second object of the invention to provide a method of making an architectural panel provided with excellent design features by improving on the way of forming depressions and protrusions in the surface of a base panel, the way of sprinkling and sticking sand to both or either of the depressed and protruded surface portions of the base panel and also the way of applying a base coat and/or or an overcoat layer respectively applied directly and through the intermediary of a particulate material to both or either of the depressed and protruded portions of the base panel.

Other objects, features, and advantages of this invention will be more apparent from the following detailed description taken in conjunction with the accompanying drawings. For the purposes of this discussion, an architectural panel will be hereinafter simply referred to as a panel, and preferred embodiments of a panel according to the invention and preferred embodiments of a method for making the same will be described hereinafter in this order.

DESCRIPTION OF THE PREFERRED EMBODIMENTS

Figure 1:
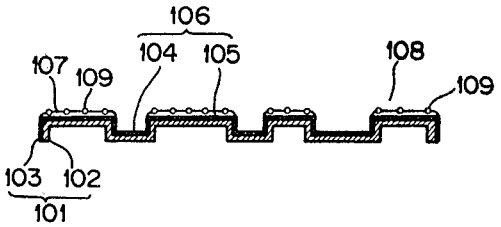
FIG. 1 is a section view of a panel according to the invention.
Figure 2:
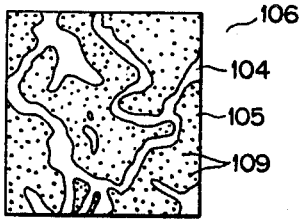
FIG. 2 is a plan view showing an example of the depressions and protrusions made in the panel of FIG. 1.
Figure 3:
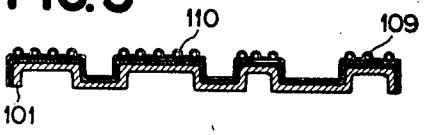
FIG. 3 is a section view similar to FIG. 1, showing another embodiment of the panel.

Referring now to FIGS. 1 to 4, a first embodiment of the invention will be described. Referring first to FIG. 1 illustrating a longitudinal sectional view showing in enlarged form a part of a panel according to the first embodiment, numeral 101 designates a base panel or surfaced treated steel sheet or the like and comprising a metallic base material 102 and a surfacing coating 103. More specifically, a colored iron sheet (ie., precoated galvanized sheet, PVC coated steel sheet or aluminum sheet may be suitably selected for the base panel 101. Mainly used as the surface treated steel sheet is a sheet which is plastically deformable and having a thickness of about 0.2 to 1.6 mm. Numeral 104 designates depressed surface portions, and 105 protruded surface portions, forming a decorative base surface 106 by the combination of these surface portions. The difference in height between the depressed and protruded portions is about 0.3 to 3 mm, mainly on the order of 0.8 mm. Although patterns which can be formed by the combination of such depressed and protruded portions are indefinite and can not be enumerated, FIG. 2 shows an example of possible patterns. Numeral 107 designates a decorative coating constituting a base coat layer which is to be applied only to the protruded or depressed portions and which performs the dual function of serving as an adhesive for sticking a particulate material that will be described later and promoting the three-dimensional effect of the depressed and protruded portions by having a color tone, lightness difference, gloss, etc., which are different from those of the surface treated steel sheet or the like. Numeral 108 designates a top layer with particulate material comprising a particulate material or sand 109 and the decorative coating 107, and the particulate material having a particle size of about 0.3 to 3 mm in diameter is stuck to the protruded portions or depressed portions only. The particulate material may be composed of at least one of those materials including silica sand, colored silica sand, vermiculite, perlite, talc, particulate glass, particulate perlite, crushed stone, etc. The distribution density of the particulate material is such that a so-called scattered distribution is used to prevent the individual particles from contacting one another. However, a dense distribution may also be used. FIG. 3 shows another embodiment of the invention which briefly speaking differs from the panel of FIG. 1 in that an overcoat layer 110 consisting for example of a transparent acrylic resin coat is applied on the decorative surface. With this panel, the overcoat layer 110 is a coating layer applied for the purpose of preventing fall-off of the particles, providing lustre on the entire panel and improving the weathering resistance of the entire panel surface. In this case, the overcoat layer may be applied by means of a spray gun or curtain flow coater, and the panel is fed for example at a speed of about 5 m/min to 80 m/min.

Figure 4:
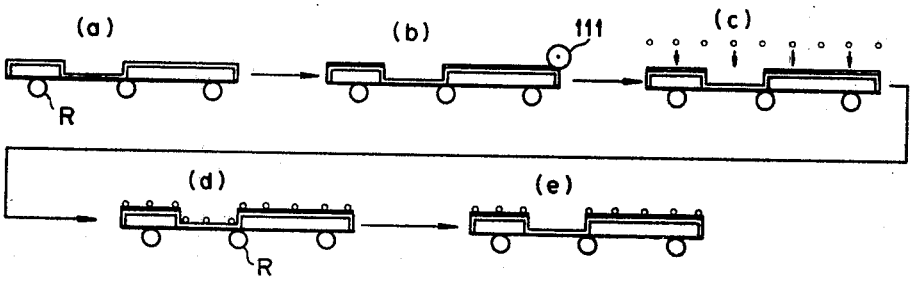
FIG. 4 is a schematic diagram showing a manufacturing process of the panel.

A method of making the above-mentioned embodiment panels will now be described in detail. FIG. 4 is a schematic diagram showing the production steps according to an embodiment method of this invention, and it is assumed that a colored steel sheet ie., precoated galvanized sheet, (beige colored) having a pattern such as shown in FIG. 2 and formed into a desired cross-sectional shape (the details will be described later) is placed on a conveying means R. This condition is shown in FIG. 4(*a*). When the thusly formed colored steel sheet is moved into a position below a roll coater 111, a decorative coating 107 (cream colored) having a thickness of about 60$\mu$ (wet) is applied by the roll coater 111 to the protruded surface portions 105 of the colored steel sheet 101 as shown in FIG 4(*b*). With the coating 107 being not cured as yet, silica sand 109 (about 28 to 32 mesh) is sprinkled at a rate of 80 particles/cm$^2$ on the steel sheet as shown in FIG. 4(*c*). While various sprinkling devices may be used, a distributing device comprising a hopper arranged on a roller and a plurality of metal screens arranged in tiers has been found satisfactory in practice. FIG. 4(*d*) shows the distribution of the scattered silica sand. The excess sand present on the depressed surface portions is removed by the step of FIG. 4(*e*). As a means of attaining this objective, the colored steel sheet may be erected at right angles to the horizontal. Thereafter, the decorative coating is cured by a drying operation (cold drying or force drying). In the case of the cold drying, when acryl emulsion was used as a coating material, the decorative coating was left to stand for about 2 to 3 months. In the case of the force drying, the decorative coating was dried by far infra red rays for one minute at about 80° to 110° C. and then it was left to stand for several hours. In the former case the hardness was F grade and the hardness was H grade in the latter case, according to the test results of JIS K 5400. Of course, by changing the heating temperature and time in many different ways, it is possible to obtain a decorative coating having a hardness of about 3-H grade. To produce the panel shown in FIG. 3, the necessary operations for applying an overcoat and drying it must be added to the above-mentioned operations as will be described later in detail.

It will be seen from the foregoing that in accordance with the methods of making the panels shown in FIGS. 1 to 4, there are the following advantages. (1) A decorative surface having an excellent three-dimensional effect can be provided by the combined effect of the depressions and protrusions formed in a surface treated steel sheet, a decorative coat and a sanded top layer on the steel sheet. (2) A decorative coating and a sanded top layer can be easily formed on a surface treated steel sheet.

Figure 5:
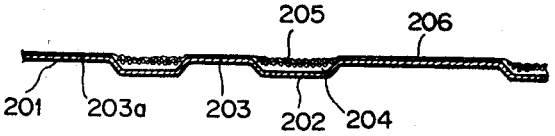
FIG. 5 is a sectional view of still another embodiment of the panel.

Other embodiments of the invention will now be described with reference to FIG. 5 to 16. Referring first to FIG. 5 illustrating an enlarged longitudinal sectional view of a part of a panel according to another embodiment, numeral 201 designates a base panel composed of a material selected from a group comprising the previously mentioned metallic sheets, thin sheet metal such as plated sheet metal and stainless steel sheet and inorganic materials such as plaster board, slate plate, calcium carbonate plate, calcium silicate plate, mortar cement plate, etc., and the base panel is provided on its surface with a decorative layer formed with depressed and protruded portions 202 and 203 arranged in a desired planar pattern. The difference in height between the planar depresssed and protruded portions in the decorative surface is less than about 3 mm and this difference in height is greater than the diameter of the particulate material which will be described later. In this case, these depressed and protruded portions may be arranged in any desired design distribution, that is, they may be arranged for example in a pattern shown in FIG. 6. Numeral 204 designates a base coat which may for example be on the order of 10 to 200 microns thickness in the dry state, and the base coat 204 is applied only to the depressions of the depressed and protruded portions 202 and 203. Also the base coat 204 has a principal function of serving as an adhesive for particulate material, and it may for example be applied by uniformly spreading a coating material, metallic coating or the like using as a binder any one of the thermosetting acrylic resin, polyester resin, alkyd resin, epoxy resin, acryl resin, acryl-polyurethane resin, non-yellowing polyurethane resin and melamine resin or any one of vinyl acetate resin, furan resin, phenolic resin, styrene resin, vinyl resin and urea resin, etc., with such means as a roll coater, spray gun or curtain flow coater. Numeral 205 designates a particulate material which will be used to fill (distribute) only the depressions of the depressed and protruded portions 202 and 203 with a high density, namely, in such a manner that the individual particles are arranged close to one another (FIG. 7) or placed one upon another in two tiers. In addition to the previously mentioned particulate materials, any of colored silicate sand, sand, crushed rock, glass beads, particulate perlite, and artificial aggregate (e.g., blast furnace slag or plastic particles) may be used as the particulate material. The particle size must be selected so as to be smaller than the difference in height between the depressed and protruded portions. The reason is that if a plane surface 203*a* of the protruded portions is lower than the surrounding depressed portions, this will cause a great change in the three-dimensional effect or appearance produced by the reflection of light, thus failing to achieve the objective of the invention, that is, the provision of the previously mentioned effects. Numeral 206 designates a decorative coating which may be a coating material similar to the previously mentioned base coat or any one of various other coating materials having different colors with or without gloss and so on, and the decorative coating may be applied by any one of the previously mentioned coating means.

Figure 6:
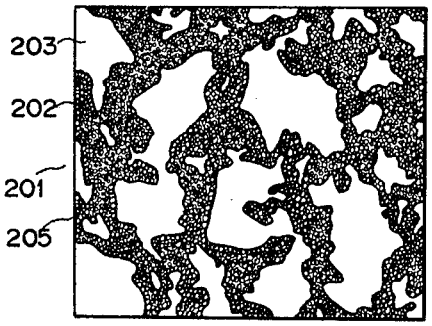
FIG. 6 is a plan view of the panel of FIG. 5 showing the pattern of the depressions and protrusions.
Figure 7:
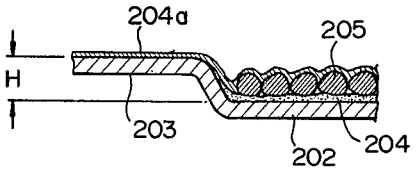
FIG. 7 is a partial enlarged view of FIG. 5.
Figure 8:
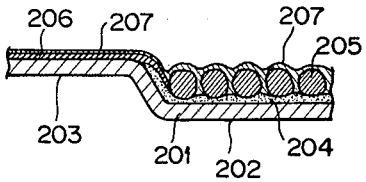
FIG. 8 is a partial enlarged view showing a modification of FIG. 7 showing the manner in which a decorative coating and an overcoat are formed and laminated.
Figure 9:
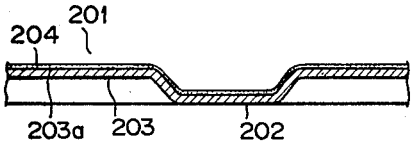
FIGS 9 through 14 are partial sectional views of the panel of FIG. 5, showing sequentially the individual production operations of the panel.
Figure 12:
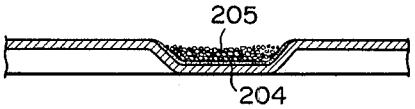
Figure 10:
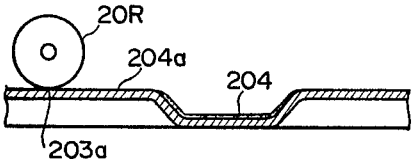
Figure 13:
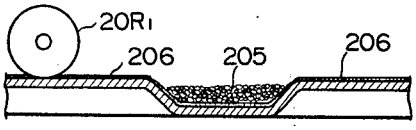
Figure 11:
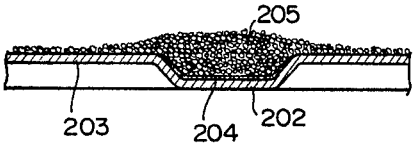
Figure 14:
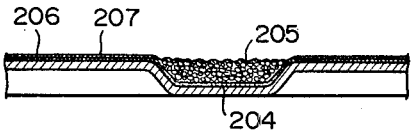
Figure 15:
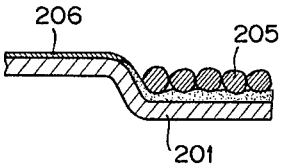
FIG. 15 is a partial enlarged end view of the panel shown in FIG. 13.

The method of making the panels shown in FIGS. 5 to 8 will now be described with reference to FIGS. 9 to 14. Using an embossed colored steel sheet ie., embossed precoated galvanized sheet, (about 0.27 to 0.55 mm in thickness) as a base panel, the base panel is formed into a flat shape or formed by bending into a channel shape or other desired cross-sectional shape which is not shown. A base coat 204 is then applied to the whole surface of depressed and protruded portions 202 and 203 of the base panel to uniform thickness of about 10 to 200 microns in the wet state as shown in FIG. 9. Then, as shown in FIG. 10, the base coat 204*a* on a plane surface 203*a* of the protruded portions in the base panel 201 is removed by a roller 20R while the base coat 204*a* is still in the uncured state. This is to prevent the sticking of particulate material 205 to the plane surface of the protruded portions 203 and establishing a production line. Thereafter, the particulate material 205 is scattered (distributed) through a sprinkler (not shown) over the depressed and protruded portions 202 and 203 in such a manner that particles are arranged one upon another satisfactorily as shown in FIG. 11. Then, the excess particles on the base panel 201 are removed by means of air spray or by turning over the base panel 201. The result obtained is shown in FIG. 12. Then, a decorative coating 206 is applied by a roll coater $20R_1$ only to the top surface of the protruded portions 203 as shown in FIG. 13. The resulting condition is shown in FIG. 15. An overcoat 207 is further applied to the decorative coating 206 as shown in FIG. 14. Thereafter, the base panel is subjected to cold drying or baking. The resulting product or panel has a plane surface with such a general feeling as shown in FIG. 6.

The foregoing represents only one embodiment of the invention, and it is possible to arrange so that the base coat 204 is subjected to forced heating so as to cure the protruded surface 203*a* earlier than the depressed surface portions, after which sand or the like is spread over the depressed and protruded portions 202 and 203 in the base panel 201 and then the excess sand is removed to feed the base panel 201 to the next processing step. It is also possible to use a transparent resin for the overcoat 207.

EXAMPLE 1

Figure 16:
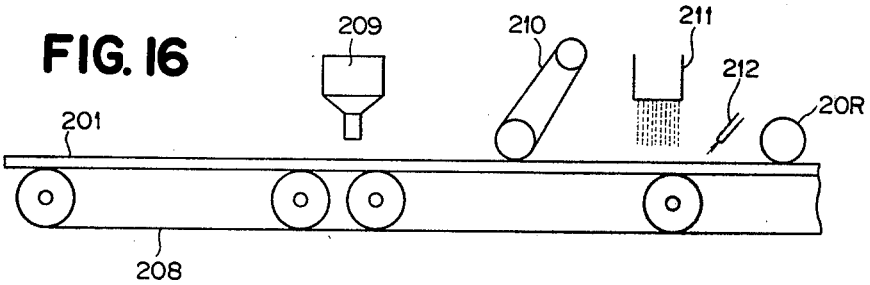
FIG. 16 is a schematic view showing means for making the panel of FIG. 5.

In this example, there was used a base panel consisting of an embossed colored steel sheet, ie., precoated galvanized sheet, having a thickness of 0.27 mm and a difference in height H of 1 mm between the depressions and the protrusions. The base coat applied was Acrylpile L (acrylic resin) of a yellowish brown color. The particulate material used consisted of silica sand of 0.5 mm$\phi$. As shown in FIG. 16, the base panel was put on a belt conveyor 208 which was moved in a predetermined direction at a speed of 60 m/min. When the base panel was moved below a flow coater 209, a base coat 204 was applied to the entire surface of the depressed and protruded portions in the base panel. The coating material had a viscosity of about 300 to 1,000 centipoise at 25° C. and the amount of coating was about 60 microns in wet state. After the expiration of about 2 to 30 seconds after the application of the base coat or particularly after it had appeared that a wet coating was applied uniformly to both the depressed and protruded portions, rolls having a roll diameter of 30 mm$\phi$ and a cloth 210 extended therearound were rotated. In this way, only the base coat (coating) formed on the protruded portions was removed (wiped off). Then, the silica sand was sprinkled by a sprinkler 211 at a rate of 100 to 1,000 g/m$^2$. The excess sand was removed by an air gun 212 with an air pressure of 2 to 50 kg/cm$^2$. Then, the particles 205 protruding upwardly from the depressed portions was depressed and the coating material sticking to the particulate material was adsorbed to the silica sand, thus practically producing no effect on the appearance of the base panel from a coloration point of view. The base panel was then dried for a desired time in the range of 1 to 30 minutes at a temperature ranging from 50° to 200° C. thus producing a product or panel having a decorative surface layer such as shown by the enlarged view of FIG. 15. An overcoat 207 was further applied and dried thus producing the panel having a cross-sectional shape as shown by the enlarged view of FIG. 7 or 8. In this case, as the coating material, a glossy transparent acrylic resin was applied in an amount ranging from about 10 to 30 microns (in wet state). The thusly obtained panel has a decorative surface layer in which the decorative coating on the plane surface or protruded surface portions was glistening or light reflective and the depressed portions was completely dull finished and made stately and grave by the color tone of the silica sand distributed highly thickly and in which the color tones as well as the glossy patterns of the depressed and protruded portions were allowed to give full play to their respective characteristic features which completely eliminating the image or feeling of metal, asbestos or the like, thus providing a peculiar appearance. This involves an advantage of making it possible to utilize effectively such materials as metal sheet, asbestos plate or the like which can be conveniently formed and worked.

The resulting advantages of the panel and the method of making the same shown in FIGS. 5 to 16 may be summarized as follows.

(1) The feeling of flatness is completely eliminated. (2) Due to the great differences in brightness, chroma, height, gloss and shade between the depressed and protruded portions, a decorative top surface is produced having doubled three-dimensional effect and dignity. (3) Due to the depressed and protruded portions arranged in any desired pattern and harmony in the correlation between the plane surface and the fine rise and fall presented by the particulate material in the depressed portions, novel hand and feel was obtained which has both a natural feeling and artificial feeling. (4) By utilizing the characteristic features of primary materials it is possible to easily produce many different patterns and consequently it is possible to produce a base panel whose inherent undesired properties are eliminated completely.

Figure 17:
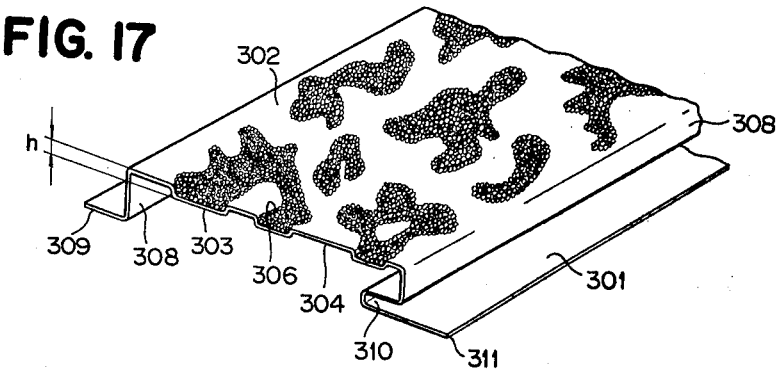
FIG. 17 is a partial perspective view showing another embodiment of the panel.
Figure 18:
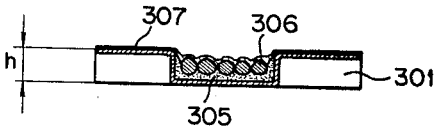
FIG. 18 is a partial enlarged view of the panel shown in FIG. 17.

Still another embodiment of the invention will now be described with reference to FIGS. 17 and 18. In FIG. 17 showing a perspective view of a panel according to this embodiment, numeral 301 designates a metallic sheet having a decorative surface layer 302 formed on the surface thereof. The decorative surface 302 is formed by embossing or the like with depressed and protruded portions 303 and 304 which are arranged in a continuous or separate form or in a so-called flecked form involving both the continued and separated depressed and protruded portions. The difference in height or so-called depth H between the depressed and protruded portions is selected slightly greater than the particle diameter of sand which will be described later. Numeral 305 designates a base coat layer formed by applying a tranparent coating material to a thickness of about 10 to 30 microns (in wet state). Acrylic resin is mainly used as the required material. As shown in enlarged form in FIG. 18 the base coat layer 305 is present only on the depressed portions 303, and it may for example be applied by applying a coating material to the whole surface of the decorative surface with a spray gun or curtain flow coater and removing (by wiping off) or rapidly curing the coating on the protruded portions 304 while the coating material in the depressed portions 303 remains uncured. Sand 306 is placed on the base coat layer 305 on the depressed portions 303. The sand 306 comprises mainly 20 to 40 mesh (84 to 42$\mu$) silica sand or colored silica sand. Numeral 307 designates an overcoat layer which may be formed by applying a coating material while the base coat layer 305 is still in wet state or after it has been cured. The overcoat layer 307 is applied by a spray or the like to a thickness of about 10 to 30 microns (in the baked or air-dried dry state) and it is then cured by baking or the like. The coating material for the layer 307 is mainly composed of a coating material such as alkyd resin, phthalic acid resin, oil free polyester resin, acrylic resin, polyurethane resin or any of their modified resins. The resin is mixed with color pigment to give a color which is different from that of the colored coating applied to the base metallic sheet or pastel color, and preferably the color should be such that it does not completely conceal the colored coating on the base metal. Numeral 308 designates side walls, 309 a joint flange, 310 a joint slot, and 311 a protruded flange, and these portions are used to make a wall by male and female joint. Of course, the side walls, etc., may be formed into any desired forms or alternatively the panel may be formed into a flat shape.

The advantages of the panel shown and described in connection with FIGS. 17 to 18 may be summarized as follows. (1) Due to the use of a base coat layer composed of a transparent coating layer and a pale colored overcoat layer, a two-color or multi-color decorative surface can be easily formed. (2) Due to the combined effect of a transparent coating (base coat layer) which slightly changes the color of the metallic sheet itself through the refraction of light and an overcoat layer, a panel having a delicate color tone is produced. (3) Due to a so-called flecked pattern in which the depressed portions are lower than the protruded portions in a decorative surface and a continuous island pattern of small rise and fall and flat protruded portions are arranged in scattered fashion, a decorative surface is produced which has an improved three-dimensional effect due to structual and optical effects and other effects.

Referring now to FIGS. 19 to 22, still another embodiment of the invention will be described. In accordance with this embodiment, a panel is produced which has a greatly improved three-dimensional effect due to the combined effect of primarily a thin metal sheet or base panel itself, secondarily the mirror reflection of a raised pattern surface and the diffused reflection of depressed pattern surface (the difference in structure), thirdly the ground color of the thin metal sheet and the color of a decorative coating (the difference in color) and fourthly a random linear pattern produced on the depressed pattern surface and/or the raised pattern surface due to the cohesion of sand. The panel is also provided with a beautiful decorative surface produced by a random pattern.

Figure 19:
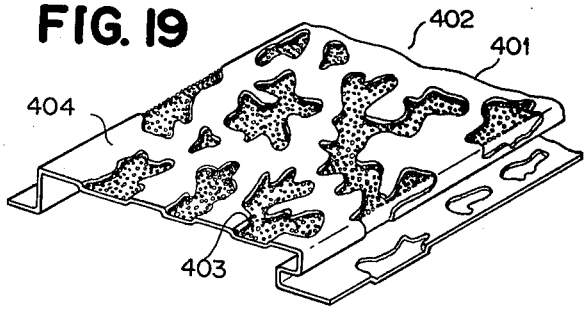
FIG. 19 is a partial perspective view showing still another embodiment of the panel.
Figure 20:
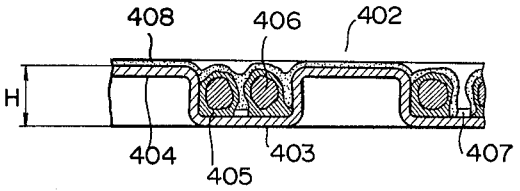
FIG. 20 is a partial enlarged view of the panel shown in FIG. 17.
Figure 21:
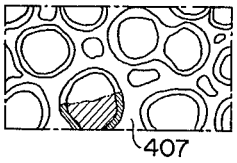
FIG. 21 is a partial enlarged plan view of the depressed portion of the panel shown in FIG. 19 with a part cut away.

Referring first to FIG. 19 illustrating a partial perspective view of a panel, numeral 401 designates a thin metal sheet constituting a base panel, and a colored steel sheet is mainly used. Numeral 402 designates an embossed pattern surface comprising depressed portions 403 and protruded portions 404 which may be arranged in a continuous pattern, separate patterns or mixed pattern. The depth H of the embossed pattern is on the order of 0.2 to 5 mm. Numeral 405 designates an adhesive coating (base coat layer) for particulate material which is applied to thickness of about 2 to 200 microns (in dry state). Numeral 406 designates a particulate material comprising at least one material selected from the group comprising the previously mentioned materials, particulate calcium silicate, particulate calcium carbonate, particulate plaster, talc, refractory stone, stone, serpentine, marble, granite and kaolin. As shown in FIG. 20, the particulate material 406 consists mainly of flakelike pieces with a particle size or diameter which is smaller than the difference in height H, and these particles are distributed scatteredly. This is to make use of the fact that sand tends to cohere a the coating material and thereby to expose the ground color of the metal sheet between the sand grains. In other words, as shown on an enlarged scale (10 times) in FIG. 21, the particulate material adhesion coating (base coat layer) and a decorative coating (overcoat layer) which will be described later are cohered by the particulate material and consequently an uncoated portion 407 is formed between the particles. This phenomenon also takes place on the side walls of the protruded portions. Numeral 408 designates a decorative coating (overcoat layer) consisting of a coating material of the same nature as the base coat layer.

Figure 22:
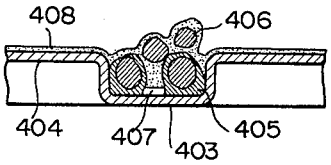
FIG. 22 is a partial enlarged view similar to FIG. 20, showing still another embodiment of the panel.

Next, the method of making the panel shown in FIGS. 19 to 22 will be described briefly. Employing a thin metal sheet consisting of a colored steel sheet (having a thickness of 0.27 mm and glossy creamy ground color), an embossed pattern consisting of the random pattern shown in FIG. 19 is formed in the metal surface with H=0.7 mm, and a particle adhesion coating material (brown colored with gloss) is prepared by mixing alkyd resin with a thinner to give a resin-diluent ratio of 10:10 and adjust the viscosity to about 800 centipoise at 25° C. Then, the coating material is applied by a spray gun or curtain flow coater to thickness of about 5 microns (in wet state) to form a particle adhesive coating 405 on the metal sheet 401. The coating 405 present on protruded portions 404 is removed by a roller or the like while the coating is still in uncured state. Then, sand (silica sand with 80% passing a 28 to 32 mesh sieve) is scattered all over an embossed pattern surface 402. The sand grains 406 other than those stuck to the coating 405 are removed by air blast, vibration or the like. Thereafter, a coating material (the same as mentioned previously) is applied in a thickness on about 10 to 30 microns by a curtain flow coater, spray or the like to form a decorative coating 408 on the embossed pattern surface 402. The assembly is then dried by baking to complete the process. The resulting panel has a surface in which an uncoated portion 407 is exposed at random between the sand grains and in which the protruded portions make a mirror reflection and the depressed portions make a diffused reflection. A panel having the similar construction may be produced even in cases where sand grains 406 are placed one upon another as shown in FIG. 22. Although not shown, a panel can be produced in which plane surface portions are scattered not only on the top surface of the raised portions but also in the depressed and protruded portions.

The advantages of the panel shown in FIGS. 19 to 22 may be summarized as follows.

(1) As will be seen from the difference between 89 gloss (incident angle=60°) for the mirror reflection of protruded portions and about 2 gloss (incident angle=60°) for the mirror reflection of depressed portions, a greatly improved three-dimensional effect is ensured and moreover a random heterogeneous surface pattern is formed. (2) Due to the difference in material (the difference in the constituents) between the protruded and depressed portions, an appearance is produced which gives an impression that is entirely different from that of the conventional products. (3) A structure is formed between the sand grains whose ground color makes a random linear pattern and also makes an iridescent pattern by reflection. (4) Due to reduced thickness of the side walls of the protruded portions by the cohesion of the sand grains and the random linear pattern, a boundary between the protruded and depressed portions is made somewhat more definite to clearly relieve the embossed pattern.

Figure 23:
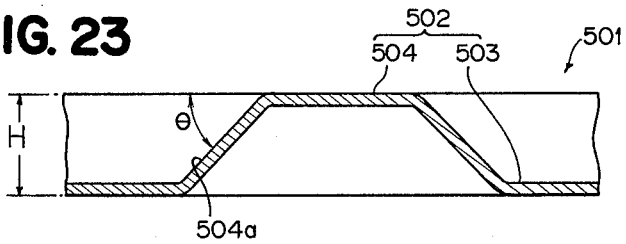
FIG. 23 is a partial enlarged sectional view of the base panel of a panel according to still another embodiment of the invention, showing in detail the shape of a protruded surface portion.
Figure 24:
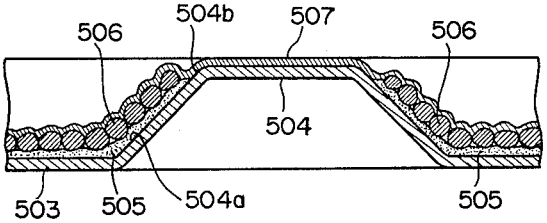
FIG. 24 is a partial enlarged sectional view showing the manner in which a base coat, sand and overcoat are applied to the base panel of FIG. 23.

Still another embodiment of the invention will now be described with reference to FIGS. 23 to 25. This embodiment is directed particularly to a panel in which the thickness of a coating on the upper side wall portions of a raised pattern is reduced by the cohesion of sand grains to thereby relieve the contour of the raised portions, and the embodiment relates to a panel having a greatly improved three-dimensional effect and a unique appearance. In the Figure, numeral 501 designates a thin metal sheet, and 502 is an embossed pattern surface comprising depressed portions 503 and protruded portions 504 having a plane top surface, with the depressed and protruded portions being arranged in a random pattern. This embossed pattern surface also has a sectional structure having the depressed and protruded portions arranged continuously or separately or involving both the continuous and separate portions. Also, each side wall 504*a* of the protruded surface portion 504 should preferably have an acute inclination angle $\theta$ of for example 30°, 45°, 60° or 70°, and its junction between the side wall and the top portions is curved. This structure has the effect of reducing the thickness of a decorative coating or overcoat in the upper side wall portions to expose the top portion from the outer surface and thereby to further relieve the raised surface portion. The depth of the embossed pattern is on the order of 0.3 to 5 mm and preferably in the range of 0.3 to 0.8 mm. Numeral 505 designates a sand adhesive coating formed by applying any of the previously mentioned resin materials to a thickness of about 2 to 100 microns (in wet state). Numeral 506 designates sand placed on the depressed portion 503 with a high density. While the particle size and shape of the sand may be determined as desired, mainly the sand is in the form of particles having an outer shape whose size is smaller or equal to the previously mentioned depth H. For example, in the case of silica sand, the particle size should be on the order of 28 to 32 meshes. The sand 506 is used to attain three main objectives of ensuring cohesion of the coating in the upper side wall portions of the raised surface, providing the depressed portions with a diffused reflection surface and breaking the air bubbles trapped in the coating. More specifically, as shown in FIG. 24, the coating 505 and a decorative coating which will be described latter are made thinner by the cohesion of the sand 506 than the coating on the top portion of the raised surface or the ordinary thickness of the coating on the side wall 504*a* in an upper portion 504*b* (boundary portion) of the side wall 504*a* of the protruded surface portion 504, and consequently the texture or ground color of the metal sheet is relieved or exposed to some extent in the random linear pattern portion. Numeral 507 designates a decorative coating (overcoat layer) composed of a coating material of the same nature as the sand adhesive coating. The coating material needs not be limited to the coating material of the same color and nature, and many different materials may be used as desired depending on the production steps used.

The method of making a panel according to the invention will now be described. Basically, the method comprises the following production steps:

(a) forming depressed and protruded portions in the surface of a base panel, (b) forming a base coat layer (this step involves removal of the undesired base coat layer), (c) sprinkling and sticking particulate material (this step involves removal of the sand on the undesired portions) and (d) forming an overcoat layer.

By combining these steps in many different ways and modifying the steps, it is possible to provide many different modifications of the method and all of these modifications fall within the scope of the method of this invention.

The individual production steps will now be described, and in the discussion to follow those which were already mentioned in connection with FIGS. 1 to 24 will be either omitted or mentioned briefly only to give a general idea as far as possible.

(a) Formation of depressions and protrusions:

In this step, depressed and protruded portions arranged in any desired pattern are formed in the surface of a base panel by embossing or other working means.

(b) Formation of base coat layer:

While a base coat layer serves a function of protecting the base panel surface and other functions, its principal purpose is to serve as an adhesive coating for paticulate material. As a result, the base coat layer need not be applied to those portions to which the particulate material need not be stuck. The base coat can be relatively easily applied only to the protruded portions by using a roller coater or other means. However, to apply same only to the depressed portions, it is necessary to apply the overcoat layer all over the depressed and protruded portions and then remove the overcoat layer on the protrusions.

Firstly, spray means may be used easily to apply the overcoat layer all over the depressed and protruded portions, and a coating material for forming the base coat layer should preferably be sprayed vertically all over the depressed and protruded portions with a view to ensuring uniform application of the coating material and preventing trapping of air in the coating.

To remove the base coat layer on the unnecessary portions (e.g., the protruded portions), many methods and means may be used as follows.

(Removal with brushes which are not shown):

A base panel formed in its surface with depressed and protruded portions is fed in a predetermined direction over a horizontal plane, and at least two brushes arranged in parallel relation above the base panel are rotated in the same direction as the direction of movement of the panel while the panel is being fed, thus removing the base coat layer present on the protruded portions.

Figure 27:
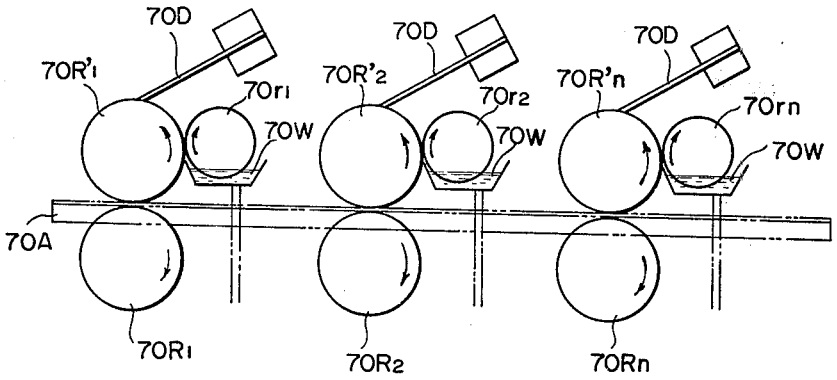
FIG. 27 is a schematic side view of an apparatus showing one form of base coat layer removing means.

(Removal with wipe roller):

Shown in FIG. 27 is a means designed to remove (wipe off) the coating material which is present on the protruded portions of an embossed pattern surface while the coating material is still in the uncured state. In other words, the means comprises for example a plurality of sets of feeding bottom rollers $70R_1$, $70R_2$, . . . , $70R_n$ and wiping rollers $70R'_1$, $70R'_2$, . . . , $70R'_n$ which are arranged in line as shown in the Figure. Transfer rollers $70r_1$, $70r_2$, . . . , $70r_n$ are respectively disposed in contact with the wipe rollers $70R_1$, $70R_2$, . . , $70R_n$ to apply a cleaning agent for removing the coating material stuck to the wiper roller surfaces. The outer surface of the rollers $70r_1$, . . . , $70r_n$ must always pass through a cleaning agent 70W such as a solvent. It is also arranged so that scraper means such as doctor knives 70D contact with the thus cleaned surface of the rollers $70r_1$, $70r_2$ to $70r_n$ as shown in the Figure to thereby prevent the cleaning agent 70W and the coating material from being carried out to the outside of the area of the wipe rollers $70r'_1$ to $70R'_n$, respectively. The roller sets $70R_1$ and $70R'_1$, and $70R_2$ and $70R'_2$, . . , $70R_n$ and $70R'_n$ are set to the same peripheral speed. This is done so that a thin metal sheet 70A is fed at a predetermined speed through these rollers without so-called deviation and slip and the coating material is wiped off when the sheet 70A comes into contact with the resilient and roughened surface structure such as rubber which is placed on the surface of the rollers $70R'_1$ to $70R'_n$, respectively. Although not shown, each of the wipe rollers may for example be formed with a random embossed pattern so that the base coat layer applied to its raised portions is removed by a doctor knife or the like so as to leave selectively the base coat layer on the protruded portions of the base panel in a random manner. In other words, the base coat layer on the protruded base panel portions need not be removed entirely.

The base coat layer removing operation may involve a protruded portion drying operation. The purpose of this operation is to dry the protruded portions by for example blowing or applying hot air, radiation heat or warm air so that when sand is sprinkled in the next operation, the sand is placed on the protruded portions with as small friction, moisture and other resistances as possible, that is, the sand is allowed to exit in a so-called free condition. In this case, the base coat on the depressed portions should not be cured at all. As a result, the drying operation should in fact be effected by simply blowing warm air of 70° to 100° C. for several seconds and in the course of the base panel being transported. However, this operation is not absolutely necessary and the operation needs not be added where the wiping operation with rollers is sufficient.

(c) Sprinkling and sticking particulate material:

Any method may be used so far as a particulate material can be sprinkled all over the depressed and protruded portions of a base panel. For example, metal wire screens with a vibrator may be used. After the particulate material has been sprinkled, the excess and/or the unnecessary particles are removed by blowing air or suction means.

(d) Forming overcoat layer:

While this operation of forming an overcoat layer follows the above-mentioned operation (c), it is possible to perform the baking and drying of the base coat layer and/or the application of a decorative coat layer (intermediate layer to the protruded portions prior to the operation (d). The base coat layer baking operation is an important operation which serves the purpose of firmly holding a particulate material, preventing the base coat from mixing with a coating material for overcoat which will be described later thus making the colors of the two coats nonuniform or causing deterioration of the coats due to their different properties and also preventing the occurrence of skim, pin holes, etc. In other words, by baking and drying the thin coat (base coat layer), it is possible to greatly decrease the occurrence of skim, pin holes, etc., and it is possible to facilitate the volatization of diluent and ensure complete bridging of the resin. As a result, full display of the weathering properties is also ensured. Another advantage is that whether the coating is non-defective or defective can be determined in the course of the operation. On the other hand, the operation of applying a decorative coat layer is particularly effective in cases where the base coat layer is colorless and/or the overcoat layer is transparent or pale colored and it is of course possible to expect combinen effects of the base coat (prime layer) and the overcoat (top layer).

Also, the overcoat layer can be made glossy or dull, and a spray, curtain flow coater or the like coating means may be employed. An example in which an overcoat layer is applied by spray coating all over the base panel from above the particulate material, will now be described with reference to FIGS. 25 and 26.

Figure 25:
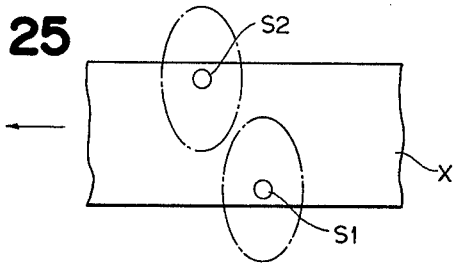
FIG. 25 and 26 are plan views showing different spray patterns for the spray guns used as an overcoat layer forming means.
Figure 26:
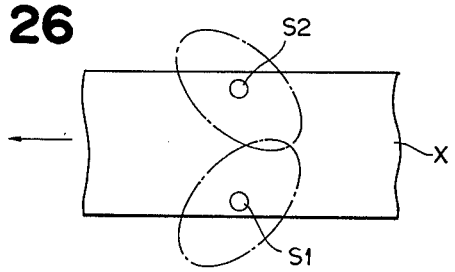

In other words, FIG. 25 shows a manner in which a pair of spray guns $S_1$ and $S_2$ are held in position to face (at 90° ) a surface to be coated which is being moved in the direction of the arrow shown, and a coating material may be sprayed by the spray guns to form a plane spray pattern. An overcoat layer may be applied by another method in which the spray guns themselves are held in position with a certain angle of inclination and the spray guns are spaced away in some measure or alternatively the spray guns may be arranged as shown in FIG. 26 so that a coating material is sprayed with a spray pattern which overlaps in some coating area. In this case, the pattern is smaller than the coated area in the vertical plane and it is also a distorted pattern. And the coating material is applied at right angles or to follow the moving base panel. Though now shown, four or five spray guns may be used to spray a coating material with a different spray pattern.

The above-mentioned overcoat layer forming operation may be followed by a drying operation as desired.

The above-mentioned operations (b), (c) and (d) may be changed as follows. For example, a method may be used which comprises the steps of preliminarily preparing a spraying agent composed of a mixture of particulate material and coating material, spraying the agent all over the depressed and protruded portions of a base panel, removing the uncured spraying agent applied to the protruded portions and then forming an overcoat layer. Another method of making an architectural panel comprising the steps of sprinkling a resin coated particulate material over the patterned surface of a metallic base panel having depressed and protruded surface portions arrangged in a desired pattern, removing the particulate material present on the protrusions and placing them in the depressed portions, and then applying that to the particulate material to melt at least a part of the coating layer and thereby to bridge together the particles and integrally sticking the particles to the base panel, may be used satisfactorily. Since the method comprises the steps of simply sprinkling a particulate material, removing the excess particulate material and then simply applying heat to the particulate material, there are the advantages of greatly improving the environmental conditions of the working atmosphere and greatly improving the working efficiency as compared with other methods in which coating materials are used. By virtue of the fact that the particles have their own coatings, there are the advantages of preventing the occurrence of insufficient adhesion and fall-off of the particles and producing a peculiar external appearance due to the randomly exposed particulate material and the resin cooating. It is possible to use still another method comprising the steps of sprinkling a particulate material over the depressed and protruded surface portions of a base panel without forming any base coat layer, removing the unnecessary or excess particulate material by means of vibration or air spray means and forming an overcoat layer which also serves as an adhesive layer.

What I claim is:

1. An architectural panel, comprising:

a one-piece base sheet having a substantially uniform wall thickness and which is embossed to form a multitude of protruding surface area portions having substantially flat upper walls which lie within a first common plane, the remainder of said sheet consisting essentially of a multitude of depressed surface area portions located between said protruding surface area portions, said depressed surface area portions having substantially flat upper faces which lie within a second common plane which is substantially parallel with said first common plane, said second common plane being offset vertically downwardly from said first common plane a distance in the range of from 0.3 to 5 mm, said protruding surface area portions being joined to said depressed surface area portions by downwardly inclined side walls which extend at an angle of from about 30° to 70° with respect to said first common plane; adhesive base coat layers made of synthetic resin and adhered to and covering the upper faces of said depressed surface area portions and said side walls; layers of particulate solids having a particle size in the range of 28 to 32 mesh respectively adhered to said adhesive base coat layers and substantially covering same; the upper walls of said protruding surface area portions being free of adhesive base coat layers and layers of particulate solids; and an overcoat synthetic resin layer covering the entirety of said layers of particulate solids and the upper walls of said protruding surface area portions.

2. An architectural panel as claimed in claim 1 in which said base sheet is made of metal.

3. An architectural panel according to claim 2 in which the thickness of said base sheet is from about 0.2 to about 1.6 mm, and the particulate solids are selected from the group consisting of silica sand, vermiculite, perlite, talc, glass, and crushed stone.

4. An architectural panel according to claim 3 having a pair of downwardly extending end walls extending substantially perpendicular to the plane of said panel along the opposite side edges thereof, an outwardly extending joint flange extending sidewardly from the lower edge of one of said end walls, the lower edge of the other of said end walls having a reversely curved portion defining a slot and a flange protruding from the lower side of the slot.

5. An architectural panel according to claim 1 in which said protruding surface area portions and said depressed surface area portions have nonfigurative, irregular shapes.

6. An architectural panel according to claim 1 in which said base coat layers are colored.

7. An architectural panel according to claim 1 in which said overcoat layer is a transparent synthetic resin layer.

8. An architectural panel according to claim 1 in which said overcoat layer is a colored synthetic resin layer.

9. An architectural panel according to claim 1 including a layer of insulating material laminated to the lower surface of said panel.

* * * * *